US009488430B2

(12) United States Patent
Hawley

(10) Patent No.: US 9,488,430 B2
(45) **Date of Patent: *Nov. 8, 2016**

(54) EJECTION PORT DUST GATE FOR AUTOMATIC WEAPONS

(71) Applicant: Craig P. Hawley, Jonesville, FL (US)

(72) Inventor: Craig P. Hawley, Jonesville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/929,827

(22) Filed: Nov. 2, 2015

(65) Prior Publication Data

US 2016/0153736 A1 Jun. 2, 2016

Related U.S. Application Data

(62) Division of application No. 14/244,061, filed on Apr. 3, 2014, now Pat. No. 9,188,405.

(51) Int. Cl.
*F41A 35/02* (2006.01)

(52) U.S. Cl.
CPC ..... *F41A 35/02* (2013.01); *Y10T 29/49863* (2015.01)

(58) Field of Classification Search
CPC ..... F41A 35/02
USPC ..... 42/98, 106, 108, 1.05, 96, 72, 73, 42/71.01, 75.01, 75.02, 75.03, 46, 47, 42/191.01; 89/199, 22, 23, 17, 1.1; 16/229, 71, 76, 263
See application file for complete search history.

(56) References Cited

U.S. PATENT DOCUMENTS 464,201 A * 12/1891 Rowland ..... A47K 10/22 16/229
1,274,429 A * 8/1918 Lilly ..... E05F 1/1016 16/76
1,365,592 A * 1/1921 Johnston ..... F41A 35/02 42/16
1,548,709 A * 8/1925 Browning ..... F41A 35/02 42/18
2,428,683 A * 10/1947 Sampson ..... F41A 17/56 42/16
2,493,116 A * 1/1950 Diebel ..... E05F 3/20 16/273
2,534,998 A * 12/1950 Steinbach ..... E05D 7/1011 16/229
2,670,197 A * 2/1954 Morse ..... E05F 1/1215 16/76

(Continued)

OTHER PUBLICATIONS

SI UDC Ultimate Dust Cover for 308 product information, [online, webpage, retrieved Nov. 17, 2015] from http://www.rainerarm.com/si-edc-ultimate-dust-cover-for-308?utm source=New%20Products%209%2F22%20email&utm medium=Email&utmcampaign=New%20Products%209%2F22%20email, pp. 1-3.

(Continued)

*Primary Examiner* — John D Cooper
(74) *Attorney, Agent, or Firm* — Saliwanchik, LLoyd & Eisenschenk

(57) ABSTRACT

A removable dust gate for an automatic weapon is described. The removable dust gate can include a retractable pivot pin having rod sections with compressible objects therebetween that allow the rod sections to be temporarily pushed together, shortening the length of the retractable pivot pin. When the pivot pin is shortened, it can be placed between two pin ports on the weapon. When released, the pivot pin will engage with the pin ports to secure the dust gate to the weapon in the correct position to engage with the ejection port on the weapon. By shortening the pivot pin, the dust gate can be an easily removed without having to change the design or configuration of current weapons or weapon design.

30 Claims, 6 Drawing Sheets

(56) References Cited

U.S. PATENT DOCUMENTS

| | | | | | |
|---|---|---|---|---|---|
| 2,750,185 | A * | 6/1956 | Moore | E05F 1/1016 | 16/307 |
| 2,903,735 | A * | 9/1959 | Schneider | E05D 7/1011 | 16/229 |
| 2,940,201 | A * | 6/1960 | Reed | F41A 35/02 | 42/16 |
| 3,083,400 | A * | 4/1963 | Anderson | E05F 3/02 | 16/70 |
| 3,369,316 | A * | 2/1968 | Miller | F41C 23/04 | 42/72 |
| 4,145,831 | A * | 3/1979 | Bourlet | F41A 35/02 | 42/16 |
| 4,265,042 | A | 5/1981 | Isola | | |
| 4,326,321 | A * | 4/1982 | Colognori | A44C 5/14 | 16/229 |
| 4,332,515 | A * | 6/1982 | Twyman | B63B 25/24 | 410/145 |
| 4,392,284 | A * | 7/1983 | LePage | A44C 5/145 | 16/229 |
| 4,509,240 | A * | 4/1985 | Tezuka | B25B 27/30 | 29/227 |
| 4,903,426 | A | 2/1990 | Bammate | | |
| 4,951,350 | A * | 8/1990 | Nunes | B60G 5/02 | 16/263 |
| 5,138,787 | A | 8/1992 | Riddle et al. | | |
| 5,669,252 | A | 9/1997 | Bentley | | |
| 5,845,366 | A * | 12/1998 | Kuroda | G06F 1/1626 | 16/229 |
| 5,881,150 | A * | 3/1999 | Persson | H04M 1/0216 | 16/229 |
| 5,934,002 | A | 8/1999 | Blanchet | | |
| 6,205,616 | B1 * | 3/2001 | Hwang | E05D 7/1011 | 16/229 |
| 6,701,659 | B1 | 3/2004 | Langner | | |
| 6,785,994 | B2 | 9/2004 | Christiansen | | |
| 7,240,449 | B2 | 7/2007 | Clifton, Jr. | | |
| 7,493,720 | B1 | 2/2009 | Householder | | |
| 8,732,906 | B1 * | 5/2014 | Van Gennep | E05D 11/1007 | 16/229 |
| 2005/0016051 | A1 * | 1/2005 | Fischbach | F41A 15/00 | 42/96 |
| 2011/0209607 | A1 * | 9/2011 | St. George | F41A 3/26 | 89/191.01 |
| 2012/0111183 | A1 | 5/2012 | Hochstrate et al. | | |
| 2012/0144712 | A1 | 6/2012 | Rostocil | | |
| 2014/0196338 | A1 * | 7/2014 | Lessard | F41A 3/66 | 42/16 |

OTHER PUBLICATIONS

Steves Custom Dust Covers product information, [online, webpages retrieved Jan. 6, 2014] from: http://bigborear.com/reviews/11-steves-custom-dust-covers, pp. 1-3.

DPMS Ejection Port Cover Assembly AR-15 Matte product information, [online, webpages retrieved Jan. 6, 2014] from: http:/www.midwayusa.com/product/888007/dpms-ejection-port-cover-assembly-ar-15-matte, pp. 1-6.

Ejection Port Dust Cover Black Armor Tuff .204 Ruger product information, [online, webpages retrieved Jan. 6, 2014] from: http://shopwilsoncombat.Ejection-Port-Dust-Cover-Black-Armor-Tuff-204-Ruger/productinfo/TR-EPD204/, pp. 1-2.

The Mako Group product information, [online, webpage retreived Jan. 6, 2014] from: http://www.themakogroup.com/PhotoGallery.asp?ProductCode=PEC&PhotoNumber=3, p. 1.

* cited by examiner

EJECTION PORT DUST GATE FOR AUTOMATIC WEAPONS

CROSS-REFERENCE TO RELATED APPLICATION

This application is a divisional of U.S. application Ser. No. 14/244,061, filed Apr. 3, 2014, the disclosure of which is hereby incorporated by reference in its entirety, including all figures, tables and drawings.

BACKGROUND OF INVENTION

Assault weapons have been in regular military use since at least the Viet Nam war era. Since their first introduction, military specifications have required that a dust gate be in place over the ejection port on all such weapons. An ejection port is an opening within the upper receiver of an assault weapon that allows spent casings to exit after firing. A dust gate is typically located over the ejection port, when the weapon is not being fired, to help prevent contaminants such as sand, dirt, or other debris from entering the mechanism. While most assault weapons have some type of cover to protect internal components from contaminants, the component most often referred to as a "dust gate" is utilized on the ejection port of automatic rifles.

When used on a weapon, the dust gate is held in place in the ejection port with a detent to protect the ejection port and internal components from contaminates. When the weapon is fired, an internal bolt slides past the ejection port, disengaging the detent, so that a biasing-spring on the dust gate can force the dust gate down and against the lower receiver. Occasionally, the dust gate will jam preventing the internal bolt from completing its action, thus disabling the weapon. Under most environmental conditions, a dust gate provides only minimal protection. Because of the potential for jamming the bolt, civilian, as well as active-duty military personnel, often prefer to remove the dust gate from their weapons. However, due to military requirements, the dust gate must be retained and reusable.

Removal of a dust gate can be a tedious process that requires at least partial disassembly of the weapon. Current designs utilize a pivot pin that slides through sleeves on the dust gate and fit into two pin ports on the side of the weapon. To remove the dust gate, the pivot pin can be slid towards the barrel and out of the pin ports and sleeve. There is typically a barrel nut that secures the barrel in place on the lower receiver. The dimensions of the barrel nut prevent the pivot pin from sliding completely out of the sleeves and/or pin ports. Thus, the barrel nut and barrel must be removed to completely release the dust gate. The dust gate can then be retained for later re-installment by the same method. Alternatively, the pivot pin and dust gate can be bent until the pivot pin can be disengaged from the pin ports. This technique will render the dust gate unusable.

Despite the fact that dust gates have been used on automatic weapons for over 50 years, there has been little or no improvement in the design of dust gates and particularly in the methods for removing or installing them on a weapon. To date, removal of a dust gate necessitates either significant disassembly of the weapon or effectively destruction of the pivot pin that holds the dust gate onto the weapon.

BRIEF SUMMARY

The subject invention pertains to an improved dust gate for use over an ejection port on assault weapons, particularly assault rifles such as, for example, the AR15™, SR25™, M16™, and the like. Certain embodiments of the subject invention improve upon current dust gate design by providing a pivot pin that is retractable, such as, for example, by having spring-biased components, and can be secured within the existing pin ports on a weapon. Although incorporation of this feature does not require changes to be made to the design or operation of standard dust gates, the improvements disclosed herein are applicable to alternative dust gate designs. By incorporating embodiments of the retractable pivot pin disclosed herein, a dust gate can be removed by compressing at least one end of the retractable pivot pin, to disengage that end from a pin port, without having to remove or disturb any other parts of the weapon. When installing a retractable dust gate, it is also possible to more easily set the torsion spring that biases the dust gate open, since the embodiments of a retractable dust gate allow it to be substantially assembled prior to such installation.

It should be noted that this Brief Summary is provided to generally introduce the reader to one or more select concepts described below in the Detailed Disclosure in a simplified form. This Summary is not intended to identify key and/or required features of the claimed subject matter. Other aspects and further scope of applicability of the present invention will also become apparent from the detailed descriptions given herein. It should be understood, however, that the detailed descriptions, while indicating preferred embodiments of the invention, are given by way of illustration only, since various changes and modifications within the spirit and scope of the invention will become apparent from such descriptions. The invention is defined by the claims below.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIG. 2A is a photograph of the inner face of the dust gate and the FIG. 2B is a photograph of the outer face of the dust gate.

DETAILED DISCLOSURE

Figure 1:
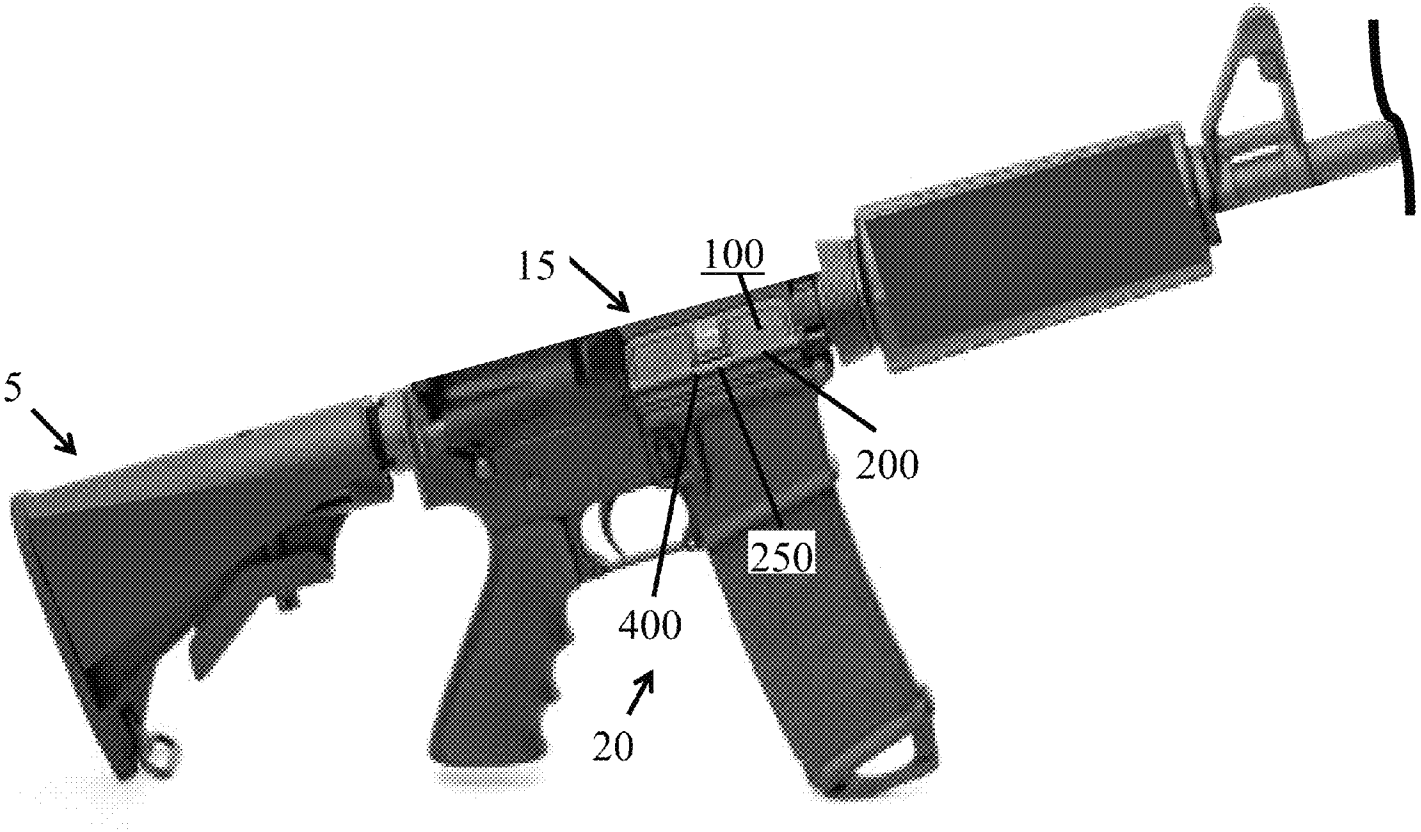
FIG. 1 illustrates an example of an automatic weapon having attached thereto a dust gate according to the embodiments of the subject invention.

Despite numerous advances in weapon design and technology, the operation of dust gates on automatic weapons has remained substantially the same throughout their history. Currently, automatic weapons that employ a dust gate over the ejection port must be at least partially disassembled in order to remove the dust gate. Usually, at least the barrel and any associated attachments must be removed from the lower receiver in order to disengage a dust gate from a weapon. If disassembly is not practical or possible, the pivot pin that pivotally holds the dust gate in place can be bent sufficiently to extract it from pin ports that help secure it to the weapon. This will permanently damage the dust gate, as the bent pivot pin cannot be reliably re-secured in the pin ports. During active fire, the initial action of the bolt sliding through the lower receiver will forcibly disengage a detent that holds the dust gate in place over the ejection port of the weapon. However, on occasion, the internal bolt jams against the detent preventing the dust gate from opening properly and disabling the weapon. Unjamming the bolt can necessitate inserting an object under the dust gate to forcibly disengage the detent. This can be dangerous with a loaded weapon and during a fire-fight is a completely impractical process.

In accordance with embodiments of the invention described herein, the inability to easily remove a dust-gate from an automatic weapon without damage to the dust gate or weapon is addressed by utilizing a retractable pivot pin to secure the dust gate within the weapon pin ports. The subject invention provides embodiments of a retractable dust gate for use on automatic weapons, which can be removed without damaging the dust gate or disassembling the weapon.

The following description will disclose that the subject invention is particularly useful in the field of automatic weapons, in particular automatic rifles. However, a person with skill in the art will be able to recognize numerous other uses to which the devices and methods of the subject invention could be applied. While the subject application describes, and many of the terms herein relate to, a use on automatic weapons, other modifications apparent to a person with skill in the art and having benefit of the subject disclosure are contemplated to be within the scope of the present invention.

The term "automatic weapon" is used herein merely for literary convenience and is not intended to limit, in any way, the type of weapon on which the embodiments of the subject invention can be used. The devices, apparatuses, methods, techniques, and/or procedures of the subject invention could be utilized on any type of automatic, semi-automatic, or single-shot weapon. While this typically includes rifles or larger military-styled weapons, it does not exclude hand guns or other weapons that may also have dust gates or that can include usage of a dust gate of the subject invention.

As used herein, and unless otherwise specifically stated, the terms "operable communication," "operable connection," "operably connected," "cooperatively engaged" and grammatical variations thereof mean that the particular elements are connected in such a way that they cooperate to achieve their intended function or functions. The "connection" or "engagement" may be direct, or indirect, physical or remote.

The present invention is more particularly described in the following examples that are intended to be illustrative only, since numerous modifications and variations therein will be apparent to those skilled in the art. As used in the specification and in the claims, the singular for "a," "an" and "the" include plural referents unless the context clearly dictates otherwise.

The examples and embodiments described herein are for illustrative purposes only and various modifications or changes in light thereof will be suggested to persons skilled in the art and are to be included within the spirit and purview of this application.

Reference will be made to the attached figures on which the same reference numerals are used throughout to indicate the same or similar components. FIG. 1 illustrates an example weapon having a removable dust gate. With reference to FIG. 1, it can be seen that embodiments of the subject invention, in general, can include a gate 100 with one or more collinear sleeves 200 fixedly attached and a biasing-spring 250. A retractable pivot pin 400, according to embodiments of the subject invention, can be moveably disposed through the one or more sleeves and the biasing-spring.

Reference is also made throughout the application to the "proximal end," "distal end," "top side" and "bottom side." As indicated in FIG. 1, the proximal end 5 is that end nearest the end of the stock of a weapon. Conversely, the distal end 10 is that end nearest the barrel exit of a weapon. The top side 15 and bottom side 20 are most easily understood by reference to the trigger location when the weapon is being fired. Thus, the top side is the area furthest above the trigger on a weapon and the bottom side is the area furthest below the trigger on a weapon.

Typically, there are two pin ports on the lower assembly of a weapon that receive each end of a standard pivot pin, to hold the dust gate in place, and in which the described retractable pivot pin can be used. The first pin port 300 at the proximal end is usually a blind hole, meaning it is closed on the proximal side to prevent the pin from sliding out. The second pin port 333 on the distal side is open on two sides. Because of current weapon design, removal of the barrel assembly is necessary, so that the pivot pin can slide through the distal end pin port to release the dust gate. Some weapon designs also utilize a "C-clip" or similar device to further secure the pivot pin on the distal end.

Embodiments of the subject invention provide a unique pivot pin assembly that can be retracted or shortened for removal from the pin ports on a weapon without having to disassemble the weapon. A retractable pivot pin 400 of the subject invention can permit a dust-gate to be removed from a weapon without damaging the dust gate or the weapon. It also allows the dust-gate to be reinstalled over the ejection port on a weapon, without having to disassemble the weapon.

As seen in FIGS. 2, 3A, 3B, and 4, a biasing-spring 250 is positioned on the pivot pin 400 and resides within a notch 260 in the gate 100. The biasing-spring 250 is used to hold the dust gate away from the ejection port when the detent 150 has been disengaged by the action of the bolt 35. The biasing-spring has two opposing legs, where the long leg 252 exerts against the inner face 25 of the dust gate and the other usually shorter leg 253, exerts against the bottom side 20 of the ejection port. When installing or reinstalling a dust gate with a standard pivot pin, the legs, particularly the one that exerts against the ejection port 40, can be difficult to put into and hold in position, as a standard pivot pin must be slid through the distal pin port 333 while the spring, as well as both opposing legs, are held in place by hand.

Figure 2:
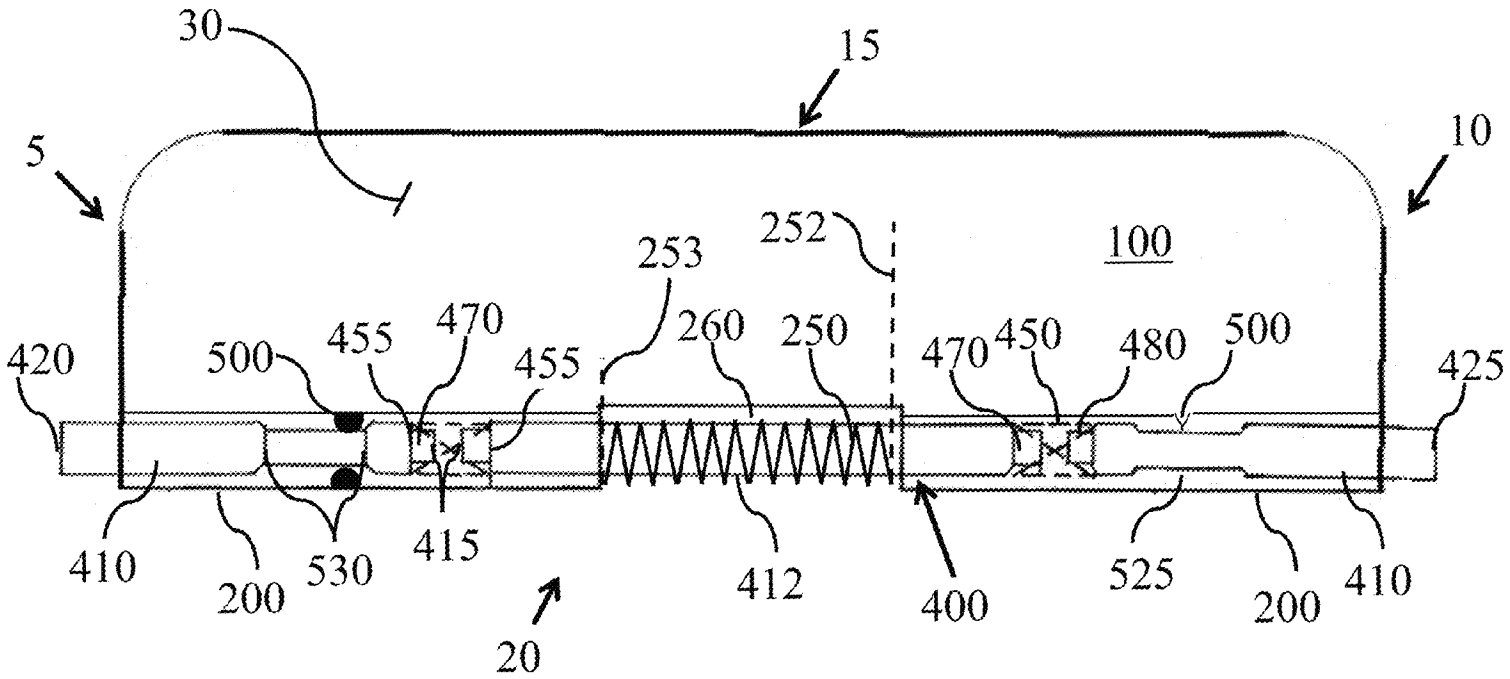
FIG. 2 is an illustration of one embodiment of the dust gate of the subject invention.
Figure 3A:
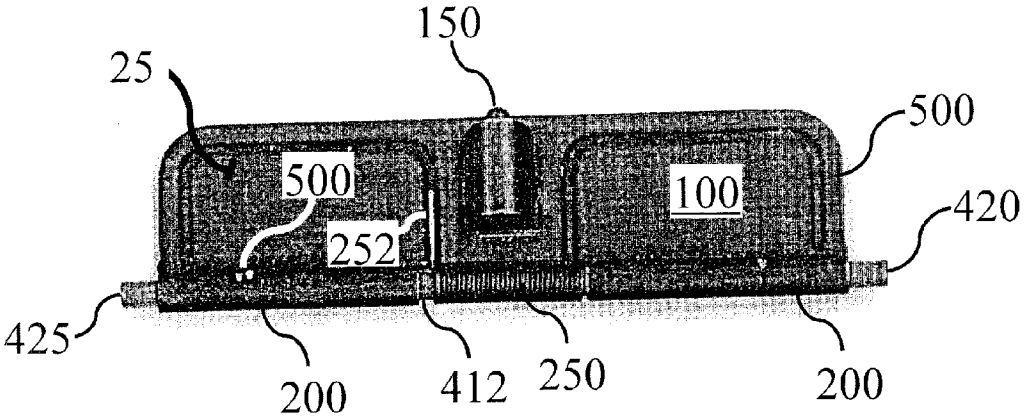
FIGS. 3A and 3B are photographs of a dust gate incorporating a retractable pivot pin, according to an embodiment of the subject invention.
Figure 3B:
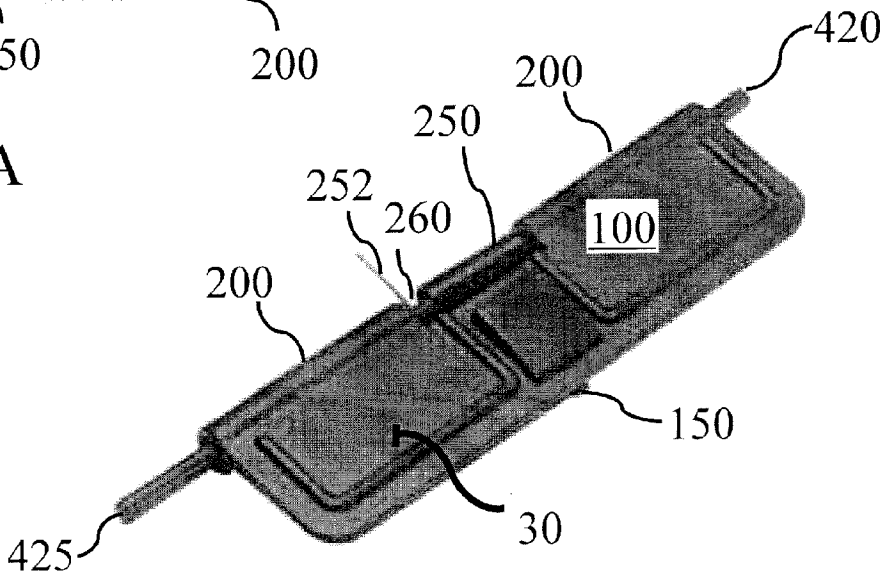
Figure 4:
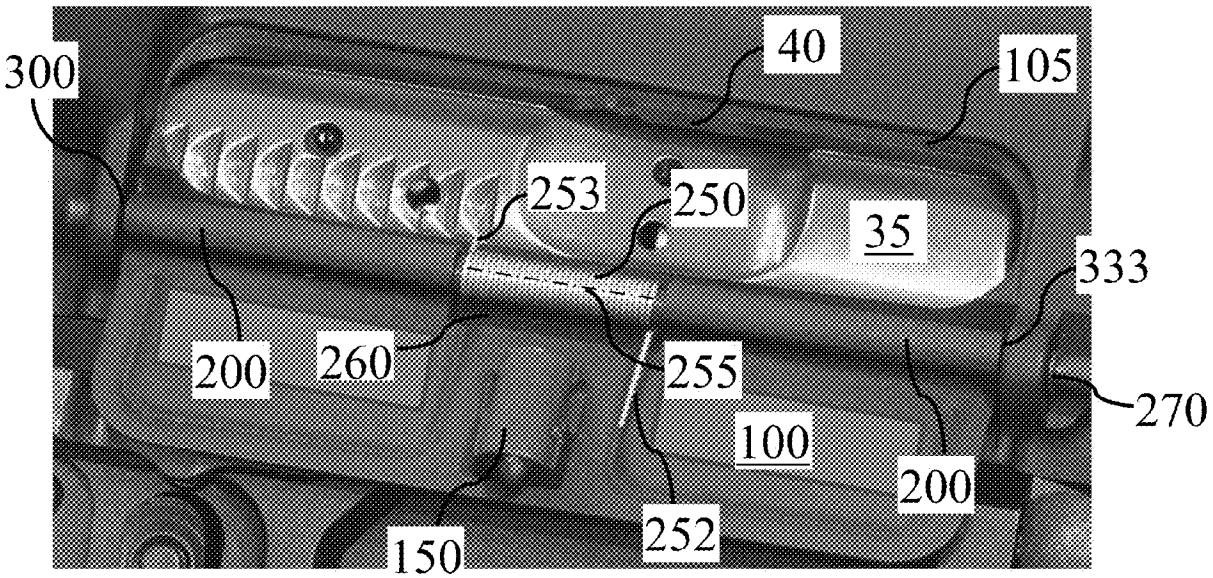
FIG. 4 is a photograph of an ejection port of an automatic weapon with a bolt therein, with a dust gate in the open position.

Advantageously, the embodiments of the subject invention provide a retractable pivot pin 400 that can be put into place within the sleeves 200 of the gate prior to installation. Likewise, the biasing-spring can also be put in place on the retractable pivot pin 400 and within the notch 260 prior to installation on a weapon. The long opposing leg 252 can be positioned on the dust gate inner face 25, as shown in FIGS. 3A and 4. The opposing short leg can be forcibly held against the dust gate inner face 25, as seen in FIG. 2, with a finger or by some other method. Once the terminal ends of the retractable pivot pin are emplaced within their respective pin holes, the short leg can be released, which will situate it against the bottom side 20 edge of the ejection port to activate the bias of the spring. Typically, when activated, the biasing-spring will tend to hold the dust gate open and lying against the weapon in the direction of the bottom side. To close the ejection port 40, the dust gate can be forcibly raised and pushed against the ejection port until the detent is engaged with the edge of the ejection port.

Figure 5:
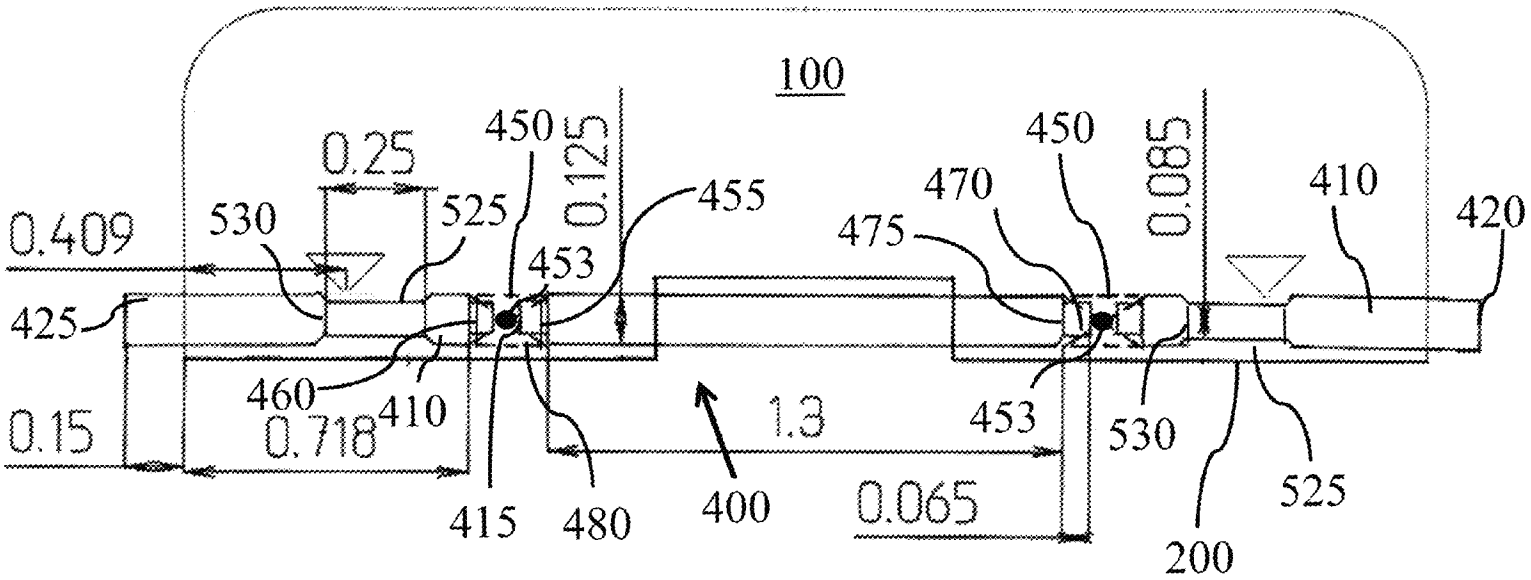
FIG. 5 is a schematic illustration of one embodiment of a retractable pivot pin dust gate of the subject invention.

Referring now to FIGS. 2 and 5, it can be seen that a retractable pivot pin 400 can have at least two rigid elongate rod sections 410 with one or more compressible objects 450 therebetween. Additional elongate rods and/or compressible objects can also be used. In a specific embodiment, shown, for example, in FIGS. 2 and 5, there are three rigid elongate rods that form a retractable pivot pin 400. With this embodiment, at least one rigid elongate central rod 412 is of sufficient length can be used to span the notch 260 between the sleeves 200, an example of which is shown in FIGS. 2 and 5. Ideally, the length of the central rod will allow it to span the notch regardless of how much the retractable pivot pin is retracted, as will be discussed below. Thus, a central rod section can span the notch regardless of how much the terminal ends are pressed towards the sides or towards the center of the dust gate. However, in certain embodiments, such as where the facing ends 415 are fixedly attached to a compressible object, which is also described below, it may not be necessary for the central rod section to span the notch distance. It is important that the biasing-spring 250 be securely held within the notch when the retractable pivot pin is in place within the sleeves. Either a central rod section 412 or a combination of rods and a compressible object can be used to hold the biasing spring in the notch.

In a preferred embodiment, the length of the central rod section is sufficient to ensure that a compressible object is located between two facing ends 415 within a sleeve 200 of the dust gate, even when the rod sections are pushed towards each other or towards the biasing-spring. FIGS. 2 and 5 illustrate an example of a central rod section having a length that ensures the compressible object is located and held within a sleeve when the rod sections are pushed towards the biasing-spring. In other words, when one or both of the terminal ends are pushed towards each other, the retractable rod is shortened by the action of the facing ends compressing the compressible object. In the preferred embodiment, when compressible object is retained within a sleeve at all times.

Thus, a compressible object can allow facing ends 415 of the elongate rods to be pushed closer together when the proximal terminal end 420 and/or the distal terminal end 425, which extend out from the respective sleeves, are pressed or pushed towards each other or towards the biasing-spring. As one or both terminal ends are pressed towards each other or towards the biasing-spring 250, the retractable pivot pin 400 is shortened at either or both of the proximal end 5 and the distal end 10. This allows the sleeves 200 and retractable pivot pin to be placed between the pin ports in the weapon. When released, the compressible object will force the facing ends apart and cause the terminal ends to jut from the ends of the sleeves, so they will engage with the respective pin ports.

Alternatively, only the distal terminal end 425 can be pressed towards the biasing-spring after the proximal terminal end 420 is placed into the first pin port 300 on the proximal side of the weapon (see FIG. 4). The dust gate and retractable pivot pin can then be rotated until the distal terminal end 425 is aligned with the distal pin port 333, at which point that terminal end can be released to engage with the distal pin port.

The retractable pin 400 beneficially also allows the dust gate to be easily removed from the pin ports. In one embodiment, the terminal ends can be pressed simultaneously to push them through and out of the pin ports. This can be done with the fingers alone or another device can be employed to push the terminal ends through the pin ports and towards the biasing-spring. In an alternative embodiment, only one of the terminal ends can be pushed through a pin port and the dust gate rotated slightly away from the weapon to pull the other terminal pin out of the other pin port. More specifically, the distal terminal end 425 can be pushed towards the biasing-spring to release it from the pin port. This allows the dust gate to be rotated out of position between the pin ports, so the proximal terminal end 420 can be pulled out of the proximal pin port 300. Once released, the compressible object can cause both terminal ends to return to their original positions, being furthest from the biasing-spring.

A dust gate is usually designed so that the gate 100 fits flush against an ejection port 40. Oftentimes, there is a recessed shoulder 105 around the periphery of at least a portion of the ejection port, as seen in FIG. 4. The gate can be pressed against the recessed shoulder so that the outer face 30 is flush with the surface of the gun. It is important that the gate not be forced against any side of the ejection port or into the recessed area. This could result in the jamming issue discussed above. This necessitates the dust gate being properly aligned, so that when it is raised into place over the ejection port, it is automatically in position to properly engage with the edges and/or recessed shoulder 105 of the ejection port.

As mentioned above, the dust gate will be opened forcibly when the weapon bolt 35 collides with the detent mechanism 150. It is important that the retractable pivot pin have sufficient strength to hold the gate in place between the pin ports and withstand the forcible rotation of the dust gate when it opens. The amount of force that a compressible object exerts on the facing ends 415 of a rod section can depend upon a variety of factors, including, but not limited to, the type of weapon, the length of the rods, the length of the gate, the number of rods used, the distance between the pin ports, the number and types of compressible objects used, how frequently the dust gate is expected to be removed and/or installed, and other factors understood by those with skill in the art. The amount of force exerted by a compressible object can directly affect the amount of force with which the terminal ends are held in the pin ports. In other words, the amount of force exerted by the terminal ends, i.e., how resistant is a compressible object, can dictate the force required to push the terminal ends together to disengage or engage them with one or more pin ports. Further, by having the one or more compressible objects retained within the one or more sleeves can allow the sleeve to provide additional support to inhibit the compressible object and/or rod sections from bending or bowing. Undesirable or unintended bowing or bending of the retractable pivot pin can shorten it, which can cause the terminal ends to pop out of the pin ports, or at least not secure the dust gate properly.

In one embodiment, the amount of force exerted by each terminal end 420 and 425 of a retractable pin 400 is between about 10 ft/lbs and 20 ft/lbs. In a more specific embodiment, the amount of force exerted by each terminal end 420 and 425 of a retractable pin 400 is approximately 16 ft/lbs. Some weapons have larger ejection ports and dust gates. These weapons could require more force to be exerted on the terminal ends, perhaps as much, or more than, 30 ft/lbs. Conversely, some weapons have smaller ejection ports and dust gates and can require less than 10 ft/lbs of force on the terminal ends. It is within the skill of a person trained in the art to determine the exact or range of force necessary to secure a dust gate on a particular weapon. Such variations are within the scope of this invention.

A compressible object 450 will preferably be made of a material or be a device with shape-memory characteristics and that can withstand repeated compression, collapsing, or other types of deformation. This can ensure that when the retractable pivot pin is within the sleeves, the tolerance or space between components remains consistent, so the dust gate remains properly aligned with the ejection pot. There are a variety of objects, devices, and materials that can be used for a compressible object 450 that meet these criteria.

Figure 7:
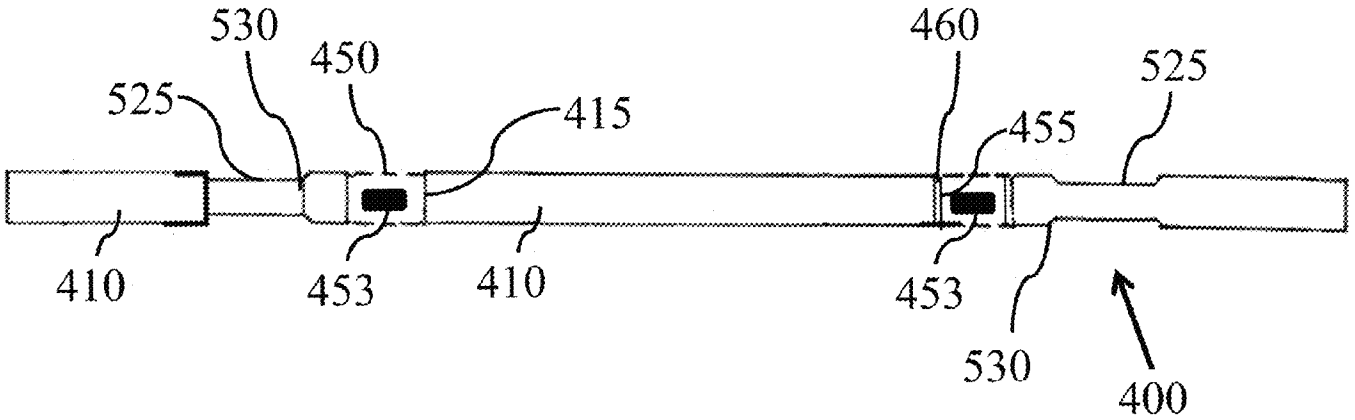
FIG. 7 illustrates an alternative embodiment of a removable pivot pin.

In one embodiment, a compressible object is a deformable material with elastic or elastomeric properties, such as, for example, various polymers, rubbers, silicone, metal alloys, ceramics, shape memory metals, and a variety of other temporarily deformable materials, or combinations thereof, known to those with skill in the art. In one embodiment, a compressible object is a shaped or formed plug of an appropriate material placed between the facing ends 415 of two rod sections 410. In a further embodiment, the deformable material can include large or small pockets or spaces 453 that contain one or more of a gas, gel, liquid, or another non-solid material. FIGS. 5 and 7 illustrate non-limiting examples of compressible object plugs of deformable material having a space 453 therein for containing different type of material than the plug material.

A plug can be of any size or shape and ideally fits closely to each facing end such that there is minimal tolerance between abutting ends 455 of the plug and the facing end, as illustrated, for example, in FIG. 7. Alternatively, in certain embodiments, there can be a pre-determined tolerance 460, or space, between abutting ends 455 of a plug and one or more facing ends, as illustrated for example, in FIG. 6. In the non-limiting example, seen in FIG. 5, more than one compressible object can be utilized between three or more rod sections. A tolerance 460 between the plug and the facing end can provide freedom of movement between the terminal ends. Further, if multiple compressible objects are used, they can each have a different compression ratio or provide different levels of resistance to compression. By way of non-limiting example, a compressible object near a terminal end could have less resistance than a compressible object further from a terminal end. This would allow less force to be used to initially press the terminal ends, but would provide greater resistance as the terminal ends are brought closer together. Alternative embodiments that provide differing amounts or resistance or consistent resistance with the compressible objects are also within the scope of this invention.

In another embodiment, the compressible object 450 is a device or mechanism that can be temporarily deformed and which can also return quickly or immediately to an original shape or configuration. There are a variety of objects that can be temporarily deformed, including, but not limited to, various types of springs (i.e., helical, Belleville, flat, leaf, volute, wave, etc.), collapsible sleeves, telescoping mechanisms, pneumatic mechanisms, and other objects or devices known in the art and combinations thereof.

A compressible object can have abutting ends 455 that are positioned flush against or touching the facing ends of rod sections. Alternatively, there can be a tolerance or space 460 between the facing end an abutting end 455 of a compressible object, just as discussed above with regard to a compressible plug. The strength or resistance that a compressible object, such as a spring, can exert is referred to as the "spring constant" value. A retractable rod can be configured with one or more springs or springs with variable or various spring constants. In one embodiment, a compressible object is a typical helical spring. In another embodiment, two or more helical springs are used between rod sections. In a further embodiment, a retractable pivot pin has two or more springs of different spring constants. Thus, for example, as the terminal ends are pressed, the resistance can increase as springs of greater spring constant are engaged.

There can also be more than one type of compressible object used between different or the same rod sections. For example, a compressible material, such as a plug, could be used between rod sections in one area of a retractable pin and compressible object, such as a spring, could be used between other rod sections in another area of the retractable pivot pin. By way of further example, a compressible plug could be combined with a compressible object between the same rod sections. A spring could surround a plug and be used between two rod sections. Two different types of springs could be combined between two rod sections. Two different types of compressible plug could be used between two rod sections. Thus, there can be a variety of combinations of compressible objects 450 that could be used between rod sections. Such variations, which provide the same function, in substantially the same way, to provide substantially the same result, are within the scope of this invention.

As mentioned above, there can be a space between the facing end 415 and a compressible object 450. Alternatively, the compressible object can be configured to maintain a position flush with or abutting the facing ends of the respective rod. In either case, it can be helpful for the compressible object to be held in the proper orientation, so that it is prevented from turning, rotating, jamming, or being otherwise moved out of proper position when the retractable rod is disposed within one or more of the dust gate sleeves 200.

In one embodiment, the facing ends 415 on rod sections and the abutting ends 455 on compressible objects are attached by, for example, with an adhesive, welding, molding, friction fit, or by other devices and techniques known to those with skill in the art. The attachment can be permanent or removable. The one or more attachments between the rod sections and compressible objects can be made before the retractable pin is inserted into the one or more sleeves. Alternatively, the one or more attachments between the rod sections and compressible objects can be made after the components of a retractable pin are inserted into the one or more sleeves.

Figure 6:
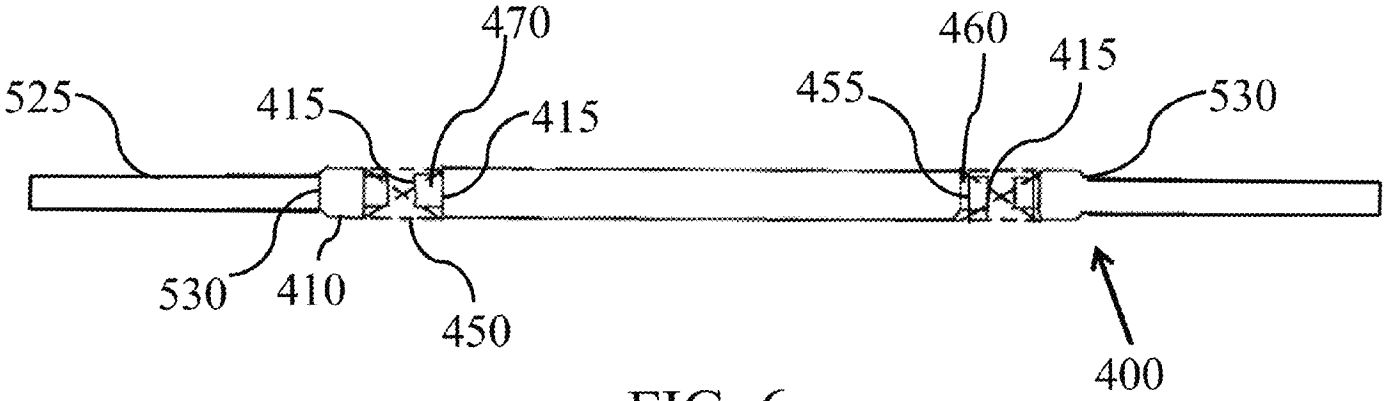
FIG. 6 illustrates an embodiment of a removable pivot pin.

In one embodiment, the facing ends of a rod section and the abutting end of a compressible object are configured to operate as a mortis and tenon. FIGS. 2, 5, and 6 illustrate non-limiting examples of such a mortis and tenon configuration. In one embodiment, a portion of the rod section at or near the facing end has a smaller diameter than the rest of the rod section, such that there is formed a tenon 470, with a full or partial annular shoulder 475. In a further embodiment, a compressible object can include a mortise 480 or depression into which the tenon on the rod section can fit. If the compressible object is a plug, the abutting ends 455 can have a mortis formed therein. If the compressible object is a spring or sleeve with an open or hollow core, the hollow center or core of the spring or sleeve can act as a mortis. FIGS. 2, 5, and 6 illustrate embodiments where the rod section 410 has a tenon 470 and the compressible object 450 has a mortis 480. In an alternative embodiment, this arrangement can be reversed, where the abutting ends of the compressible object are formed, or fitted with, or otherwise configured with a tenon and the rod section facing ends have a mortis formed therein. In a further embodiment, the mortis and tenon can have dimensions that allow them to form a friction fit with each o other, such that they cannot be separated or easily separated. Alternatively, the mortis and tenon can be attached by one or more methods described above. A person with skill in the art will be able to determine other methods and or devices by which the compressible object can be maintained in the correct alignment within a sleeve 200. Such variations are within the scope of this invention.

Once a retractable pin 400 has been installed in the one or more sleeves of a dust gate, it can be beneficial to prevent it from sliding out of a sleeve and keep it in the proper position within the sleeves to engage with an ejection port after it is placed in the pin ports. Currently, dust gate rods are maintained in the sleeves with the use of C-clamps 270 that fit around the rod, near the pin ports and prevent it from sliding in the sleeves. C-clamps are well-known in the art and can be used with the embodiments of the subject invention. FIG. 4 illustrates an example of a C-clamp on a retractable rod.

In an alternative embodiment, a sleeve can have a stay 500 that interposes with a retracting channel 525 in the rod section. In one embodiment, a stay is an indentation formed in the sleeve that causes a small portion of the sleeve or a divot to be made that protrudes into the sleeve interior to engage with the retracting channel. FIGS. 2 (right side) and 3A illustrate one example of this embodiment. The retracting channel can be a portion of a rod section that is narrower, or has a smaller diameter, than other portions of the rod section. In one embodiment, the retracting channel is a cut-out or furrow that encircles all or part of a rod section. When the stay interposes into the retracting channel, a wall or shoulder 530 of the retracting channel inhibits the retracting pin, or at least that section of the retracting pin from sliding out of a sleeve. In a further embodiment, the crimp is made in the sleeve after the retracting pivot pin is installed within the sleeve.

Other devices, techniques or mechanisms can be used as a stay, in place of a crimp, to perform the same function. In one embodiment, a spring-biased ball bearing, such as shown in the example in FIG. 2 (left side), can be used in place of the crimp. This can allow the retractable pin to be removed from a sleeve by application of sufficient force to push or pull the pin from the sleeve. Alternatively, a flexible stop can be positioned in the retracting channel to perform the same function as a spring-biased ball bearing. A non-flexible or non-moveable object could also be used that would provide the same function as a crimp and prevent the pin from being removed from a sleeve. It is within the skill of a person trained in the art to determine any of a variety of ways in which a retracting pin can be held within a sleeve. Such alternatives, which provide the same function, in substantially the same way, with substantially the same result, are within the scope of this invention.

In one embodiment, shown by way of example in FIG. 5, the retracting channel 525 is a portion of the rod section that is narrower or of smaller diameter. More specifically, the retracting channel can be a cut-out or recessed area that encircles the rod section and is defined by two walls 530 or shoulders on either side. With this embodiment, the width of the retracting channel, i.e., the distance between the walls, is large enough to allow the terminal ends to be pushed towards the biasing-spring, as described above. The retracting channel can also be located on the rod section in a location where the stay 500 can abut a wall or shoulder 530 so as to hold the rod 400 components in place within the sleeves. For example, a stay can be located so that when a rod section is not being retracted or pushed into the sleeve, the stay keeps the biasing-spring and dust gate in the proper position to be aligned with the ejection port.

In an alternative embodiment, the retracting channel extends to the terminal end of a rod section such that it is defined by having a single wall 530. With this embodiment, the width of the retracting channel 525 extends from the wall 530 to the terminal end 420 or 425 of a rod section. FIG. 6 illustrates one example of this embodiment. Again, a stay can be located, usually close to or against the single wall 530, so that when a rod section is not being retracted or pushed into the sleeve, the stay keeps the biasing-spring and dust gate in the proper position to be aligned with the ejection port.

The embodiments of the subject invention provide improvements to a weapon dust gate that have not heretofore been realized. The advantages of the dust gate embodiments described herein are the ability to remove and reinstall a dust gate on a weapon without damaging either the weapon or the dust gate, the ability to remove the dust gate without disassembling any portion of the weapon, and the ability to remove or install a dust gate without the need for specialized equipment or skill. While dust gates have been in use on weapons for many decades, the problems associated with their use have never been adequately addressed. The improvements described herein represent a significant improvement in dust gate design and operation.

All patents, patent applications, provisional applications, and other publications referred to or cited herein are incorporated by reference in their entirety, including all figures and tables, to the extent they are not inconsistent with the explicit teachings of this specification. Additionally, the entire contents of the references cited within the references cited herein are also entirely incorporated by reference.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. Further, when a particular feature, structure, or characteristic is described in connection with any embodiment, it is within the purview of one skilled in the art to affect such feature, structure, or characteristic in connection with other ones of the embodiments.

The invention has been described herein in considerable detail, in order to comply with the Patent Statutes and to provide those skilled in the art with information needed to apply the novel principles, and to construct and use such specialized components as are required. However, the invention can be carried out by specifically different equipment and devices, and various modifications, both as to equipment details and operating procedures can be effected without departing from the scope of the invention itself.

Further, although the present invention has been described with reference to specific details of certain embodiments thereof and by examples disclosed herein, it is not intended that such details should be regarded as limitations upon the scope of the invention except as and to the extent that they are included in the accompanying claims.

I claim:

1. An ejection port dust gate adapted to be attached to an ejection port of a weapon, the ejection port dust gate comprising:

a gate having at least one sleeve and a notch;

a retractable pivot pin disposed through the at least one sleeve, the retractable pivot pin comprising two or more collinear rod sections each with at least one facing end directed towards a facing end on another collinear rod section, where two of the two or more collinear rod sections further comprise terminal ends, where at least one of the terminal ends extends from the at least one sleeve in the gate;

at least one compressible object between at least two facing ends on collinear rod sections that allows the at least two facing ends to be brought closer together when at least one of the terminal ends is pushed towards another of the terminal ends;

a retracting channel in at least one of the two or more collinear rod sections; and a stay within the at least one sleeve that engages with the retracting channel.

2. An ejection port dust gate according to claim 1, comprising at least three collinear rod sections, wherein at least one collinear rod section spans the notch.

3. An ejection port dust gate according to claim 2, wherein the at least one compressible object comprises a shape-memory material.

4. An ejection port dust gate according to claim 3, wherein the at least one compressible object is a spring.

5. An ejection port dust gate according to claim 4, wherein the at least one compressible object further comprises a plug of compressible material.

6. An ejection port dust gate according to claim 3, wherein the at least one compressible object is a plug of deformable material.

7. An ejection port dust gate according to claim 3, wherein at least one of the at least two collinear rod sections comprises a retracting channel having one wall.

8. An ejection port dust gate according to claim 3, wherein at least one of the at least two collinear rod sections comprises a retracting channel defined by two walls.

9. An ejection port dust gate according to claim 1, wherein the stay comprises a spring-biased ball-bearing.

10. An ejection port dust gate according to claim 1, wherein the stay comprises a flexible stop within the sleeve.

11. An ejection port dust gate according to claim 1, wherein the stay comprises a depression within the sleeve that forms a divot in the sleeve that interposes into the retracting channel.

12. An ejection port dust gate according to claim 11, further comprising a tenon on at least one facing end.

13. An ejection port dust gate according to claim 12, further comprising a biasing-spring positioned within the notch and having a center axis that is positioned collinear with the at least one sleeve, such that the at least one rod section is disposed through the biasing-spring and the at least one sleeve to secure the biasing-spring in the notch.

14. An ejection port dust gate according to claim 1, wherein the stay comprises a non-moveable object that crosses over the retracting channel.

15. An ejection port dust gate according to claim 14, further comprising a mortis in at least one compressible object, where the mortis engages with the tenon to secure the position of the compressible object in the sleeve.

16. A retractable pivot pin for securing a dust gate on a weapon, the retractable pin comprising:

two or more collinear rod sections each with at least one facing end directed towards a facing end on another collinear rod section, where two of the two or more collinear rod sections further comprise terminal ends, where at least one terminal end extends from at least one sleeve in the gate and has a dimension that allows it to be engaged with a pin port on the weapon;

at least one compressible object between at least two facing ends on the collinear rod sections that allows the at least two facing ends to be brought closer together when at least one of the terminal ends is pushed towards another of the terminal ends, a retracting channel in at least that collinear rod section that has a terminal end that extends from the sleeve, such that, when the retractable pivot pin is disposed through the sleeve in the dust gate on the weapon, the at last one terminal end extending from the sleeve is engageable with at least one pin port on the weapon.

17. A retractable pin according to claim 16, comprising at least three collinear rod sections, wherein at least one spans a notch in the sleeve.

18. A retractable pin according to claim 16, wherein the at least one compressible object comprises a shape-memory material.

19. A retractable pin according to claim 16, wherein the compressible object comprises a spring.

20. A retractable pin according to claim 16, wherein the at least one compressible object further comprises a plug of compressible material.

21. A retractable pin according to claim 16, wherein the at least one compressible object comprises a plug of deformable material.

22. A retractable pin according to claim 16, further comprising a stay engageable with the retracting channel for securing at least that collinear rod section within the sleeve.

23. A retractable pin according to claim 22, wherein the stay comprises at least one of a spring-biased ball bearing, a flexible stop, a divot in the sleeve that interposes into the retracting channel, and a non-moveable object that crosses over the retracting channel.

24. A retractable pin according to claim 22, wherein at least one of the at least two collinear rod sections comprises a retracting channel having one wall.

25. A retractable pin according to claim 22, wherein at least one of the at least two collinear rod sections comprises a retracting channel defined by two walls.

26. A retractable pin according to claim 22, further comprising a tenon on at least one facing end of at least one collinear rod section.

27. A retractable pin according to claim 26, further comprising a mortis in at least one compressible object, where the mortis engages with the tenon to secure the position of the compressible object in the sleeve.

28. A method for securing an ejection port dust gate adapted to be attached to an ejection port of a weapon, the ejection port dust gate comprising:

a gate having an inner face, at least one sleeve, and a notch;

a biasing-spring positioned within the notch with a center axis that is positioned collinear with the at least one sleeve, and having a long spring leg, and a short spring leg;

a retractable pivot pin disposed through the at least one sleeve and the biasing-spring, the retractable pivot pin comprising, two or more collinear rod sections each with at least one facing end directed towards a facing end on another collinear rod section, where two of the two or more collinear rod sections further comprise terminal ends, where at least one of the terminal ends extends from the at least one sleeve in the gate;

at least one compressible object between at least two facing ends on collinear rod sections that allows the facing ends to be brought closer together when at least one of the terminal ends is pushed towards the biasing spring, a retracting channel in at least one of the two or more collinear rod sections; and a stay within at least one sleeve that engages with the retracting channel; wherein the method comprises;

positioning the long spring leg against the inner face of the gate;

holding the short spring leg against the inner face of the gate;

pushing at least one of the terminal ends towards the other terminal end to shorten the retractable pivot pin;

positioning the retractable pivot pin between two opposing pin ports on the weapon;

releasing the at least one terminal end being pushed, so that the at least one compressible object moves the terminal ends apart, so that the terminal end being pushed engages with at least one pin port in the weapon; and releasing the short spring leg to engage with the weapon and activate the bias of the spring.

29. The method according to claim 28, further comprising positioning one end of the at least one sleeve against a first pin port on the weapon, rotating the dust gate until the terminal end being pushed is aligned with a second pin port on the weapon, and releasing the terminal end so that it engages with the second pin port to secure the dust gate between the two pin ports.

30. A weapon comprising:

at least two opposing pin ports;

a removable ejection port dust gate adapted to be attached to the weapon, the ejection port dust gate comprising:

a gate having at least one sleeve and a notch;

a retractable pivot pin disposed through the at least one sleeve, the retractable pivot pin comprising two or more collinear rod sections each with at least one facing end directed towards a facing end on another collinear rod section, where two of the two or more collinear rod sections further comprise terminal ends, where at least one extends from the at least one sleeve in the gate;

at least one compressible object between at least two facing ends on collinear rod sections that allows the at least two facing ends to be brought closer together when at least one of the terminal ends is pushed towards another of the terminal ends;

a retracting channel in at least one of the two or more collinear rod sections; and a stay within the at least one sleeve that engages with the retracting channel such that disposing the at least one terminal end extending from the sleeve within at least one pin port secures the removable ejection port dust gate on the weapon.

* * * * *